US009422806B2

(12) United States Patent
Wang et al.

(10) Patent No.: US 9,422,806 B2
(45) Date of Patent: Aug. 23, 2016

(54) DOWNHOLE MONITORING USING MAGNETOSTRICTIVE PROBE

(71) Applicants: Ke Wang, Houston, TX (US); Zhiyue Xu, Cypress, TX (US); Carlos A. Prieto, Houston, TX (US)

(72) Inventors: Ke Wang, Houston, TX (US); Zhiyue Xu, Cypress, TX (US); Carlos A. Prieto, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 403 days.

(21) Appl. No.: 14/046,332

(22) Filed: Oct. 4, 2013

(65) Prior Publication Data

US 2015/0096745 A1 Apr. 9, 2015

(51) Int. Cl.

| | |
|---|---|
| ***G01N 27/72*** | (2006.01) |
| ***E21B 47/06*** | (2012.01) |
| ***E21B 43/26*** | (2006.01) |

(52) U.S. Cl.

CPC ..... *E21B 47/065* (2013.01); *E21B 43/26* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,456,715 | A | 7/1969 | Freedman et al. | |
| 3,540,265 | A * | 11/1970 | Lynnworth | G01N 29/11 374/119 |
| 4,483,630 | A | 11/1984 | Varela | |
| 5,022,014 | A | 6/1991 | Kulczyk et al. | |
| 5,274,328 | A | 12/1993 | Begin et al. | |
| 5,320,325 | A | 6/1994 | Young et al. | |
| 5,406,200 | A | 4/1995 | Begin et al. | |
| 5,941,307 | A | 8/1999 | Tubel | |
| 6,009,948 | A | 1/2000 | Flanders et al. | |
| 6,279,653 | B1 | 8/2001 | Wegener et al. | |
| 6,517,240 | B1 | 2/2003 | Herb et al. | |
| 6,644,848 | B1 | 11/2003 | Clayton et al. | |
| 7,377,333 | B1 | 5/2008 | Sugiura | |
| 7,779,912 | B2 | 8/2010 | Gissler | |
| 2006/0113089 | A1 * | 6/2006 | Henriksen | E21B 34/08 166/386 |
| 2006/0146337 | A1 | 7/2006 | Hartog | |
| 2007/0229232 | A1 | 10/2007 | Hall et al. | |

(Continued)

FOREIGN PATENT DOCUMENTS

| | | | |
|---|---|---|---|
| CN | 102411031 | B | 12/2012 |
| EP | 870900 | A1 | 10/1998 |

(Continued)

OTHER PUBLICATIONS

PCT International Search Report and Written Opinion: International Application No. PCT/US2014/053662; International Filing Date: Sep. 2, 2014; Date of Mailing: Dec. 12, 2014; pp. 1-10.

(Continued)

*Primary Examiner* — David Andrews
*Assistant Examiner* — Ronald Runyan
(74) *Attorney, Agent, or Firm* — Cantor Colburn LLP

(57) ABSTRACT

A system, method and apparatus for controlling a downhole operation is disclosed. A tool is operated to perform the downhole operation at a selected downhole location using a first value of an operation parameter of the tool. A magnetostrictive probe is used to determine a temperature profile along a section of a wellbore related to the operation being performed using the first value of the operation parameter. At least one temperature of the temperature profile is compared to a selected threshold. The operation parameter is altered to a second value based on the comparison of the temperature profile to the selected threshold.

17 Claims, 4 Drawing Sheets

(56) References Cited

U.S. PATENT DOCUMENTS

| | | | | |
|---|---|---|---|---|
| 2008/0163692 | A1 | 7/2008 | Huang et al. | |
| 2009/0314546 | A1 | 12/2009 | Mintchev et al. | |
| 2010/0259252 | A1 | 10/2010 | Kim et al. | |
| 2011/0192597 | A1 | 8/2011 | Roddy et al. | |
| 2011/0226469 | A1 * | 9/2011 | Lovell | E21B 47/1005 166/250.01 |
| 2011/0292384 | A1 | 12/2011 | Ramos et al. | |
| 2012/0147924 | A1 | 6/2012 | Hall | |

FOREIGN PATENT DOCUMENTS

| | | | |
|---|---|---|---|
| EP | 1691173 | A1 | 8/2006 |
| WO | 2011048373 | A2 | 4/2011 |

OTHER PUBLICATIONS

PCT International Search Report and Written Opinion; International Application No. PCT/US2014/059305; International Filing Date: Oct. 6, 2014; Date of Mailing: Jan. 16, 2015; pp. 1-12.

PCT International Search Report and Written Opinion; International Application No. PCT/US2014/059302; International Filing Date: Oct. 6, 2014; Date of Mailing: Mar. 18, 2015; pp. 1-8.

Brimmer, A.R.; "Deepwater Chemical Injection Systems: The Balance Between Conservatism and Flexibility," PTC 18308, 2006 Offhore Technology Conference, Houston, Texas, U.S.A., May 1-4, 2006, pp. 1-14.

Daw, Joshua et al.; "Ultrasonic Thermometry for In-Pile Temperature Detection," Seventh Americal Nuclear Society International Topical Meeting on Nuclear Plant Instrumentation Control and Human-Machine Interface Technologies NPIC&HMIT 2010, Los Vegas, Nevada, Nov. 7-11, 2010, pp. 1-11.

MTS Sensors; "Magnetostrictive Linear-Position Sensors," Technical Paper, 551045 D, 2006, pp. 1-6.

Dr. Peter Collins; "Staying on Top From the Desktop," World Pipelines, vol. 13, No. 07, Jul. 2013, 3 pages.

* cited by examiner

DOWNHOLE MONITORING USING MAGNETOSTRICTIVE PROBE

BACKGROUND

1. Field of the Disclosure

The present invention is related to a method of controlling downhole operations and, in particular, a method of measuring temperatures used in control of equipment used in a wellbore.

2. Background of the Art

Various downhole operations, such as drilling, production, fracturing operation, etc., generate heat through one or more processes. For example, heat may be generated due to the mechanical action of a drill bit against a wall of a borehole, an explosion used in perforation operations, chemical reactions occurring during a fracking or well stimulation operation, etc. Additionally, various tools along a work string, such as an electric submersible pump, a flow control device, a hydraulic motor, etc. may generate heat. In order to control the performance and production of downhole tools and to operate downhole tools within their specifications, an operator will monitor a downhole temperature. However, most current temperature sensing technologies, including resistance temperature detectors and thermocouple, are only able to provide temperature measurements at a single location in the wellbore. Single location measurements are often insufficient for monitoring these various downhole tools and operations.

SUMMARY OF THE DISCLOSURE

In one aspect, the present disclosure provides a method of controlling a downhole operation, the method including: controlling a tool to perform the downhole operation at a selected downhole location using a first value of an operation parameter of the tool; using a magnetostrictive probe to determine a temperature profile along a section of a downhole tool or wellbore related to the operation being performed using the first value of the operation parameter; and compare the temperature profile to a selected threshold; and alter the operation parameter to a second value based on the comparison of the temperature profile to the selected threshold.

In another aspect, the present disclosure provides an apparatus for controlling an operation downhole, the apparatus including: a tool configured to perform the operation at a downhole location according to an operation parameter of the tool; a magnetostrictive probe extending along a section of tool configured to obtain a temperature profile along the section of the tool related to the operation being performed by the tool; a processor configured to: determine a temperature profile along a section of a downhole tool or wellbore related to the operation using the magnetostrictive probe, compare the temperature profile to a selected threshold, and alter the operation parameter based on the comparison of the temperature profile to the selected threshold.

In yet another aspect, the present disclosure provides a system for controlling a downhole operation, the system including: a work string; a tool conveyed by the work string at a downhole location in a wellbore, a tool configured to perform the downhole operation using an operation parameter; a magnetostrictive probe extending along the workstring configured to obtain a temperature profile related to the downhole operation; and a processor configured to: receive the temperature profile from the magnetostrictive probe, compare the temperature profile to a selected threshold, and alter the operation parameter based on the comparison of the temperature profile to the selected threshold.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
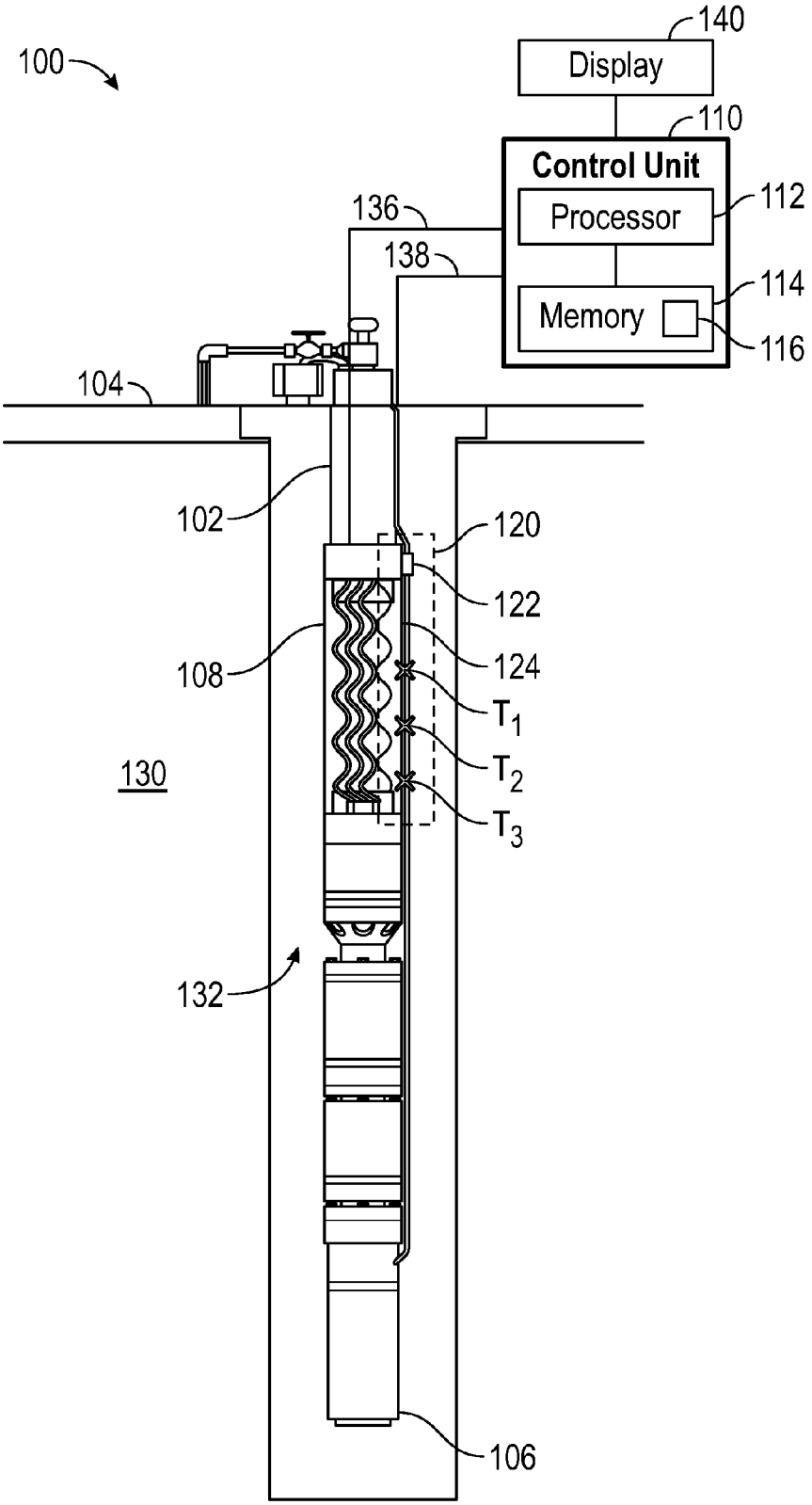
FIG. 1 shows a downhole system that includes a temperature measurement system for controlling operation of the downhole system in an exemplary embodiment of the disclosure.

FIG. 1 shows a downhole system 100 that includes a temperature measurement system for controlling operation of the downhole system 100 in an exemplary embodiment of the disclosure. The downhole system 100 includes a work string 102 disposed in a wellbore 132 formed in a formation 130. The work string 102 extends in the wellbore 132 from a surface location 104 to a downhole location 106. The work string 102 may include a drill string, a production string, a fracturing system including a multi-stage fracturing system, a perforation string, etc. A tool 108 for performing a downhole operation is conveyed to a selected depth of the wellbore by the work string 102. The tool 108 may be an electric submersible pump, a flow control device, a hydraulic motor, or other heat generating downhole tool, for example. The tool 108 may be coupled to a control unit 110 via cable 136. The control unit 110 controls the tool 108 to perform various downhole operations, such as drilling, fracking or acid stimulation, perforation, production, etc. In various embodiments, the control unit 110 may be at a surface location 104 or at a suitable downhole location in the work string 102. The control unit 110 includes a processor 112, a memory location or memory storage device 114 for storing data obtained from the downhole operation of the tool or values of operational parameters of the tool 108, and one or more programs 116 stored in the memory storage device 114. When accessed by the processor 112, the one or more programs 116 enable the processor 110 to perform the methods disclosed herein for controlling operation of the tool 108 using downhole temperature measurements. Temperature measurements may be displayed at display or monitor 140. The data may be stored downhole or may be sent to the surface without be stored downhole. Processing may therefore occur either downhole or uphole at the surface location 104. Thus, the methods disclosed herein may be performed in a closed-loop downhole system and in real-time.

The work string 102 further includes a temperature sensor 120 for obtaining measurements of temperature at a plurality of locations or depths along the work string 102. The temperature sensor 120 includes a magnetostrictive transducer 122 and a metal probe 124. The temperature sensor 120 may be coupled to control unit 110 via cable 138. The control unit 110 may send signals to activate the temperature sensor 120 and receive from the temperature sensor 120 measurements suitable for determining a temperature map at multiple locations along the metal probe 124, such as indicted by temperatures $T_1$, $T_2$ and $T_3$. The temperature measurements may be obtained at a location exterior to the work string 102 or interior to the work string 102, in various embodiments. Details of the temperatures sensor 120 are discussed below with respect to FIG. 2.

Figure 2:
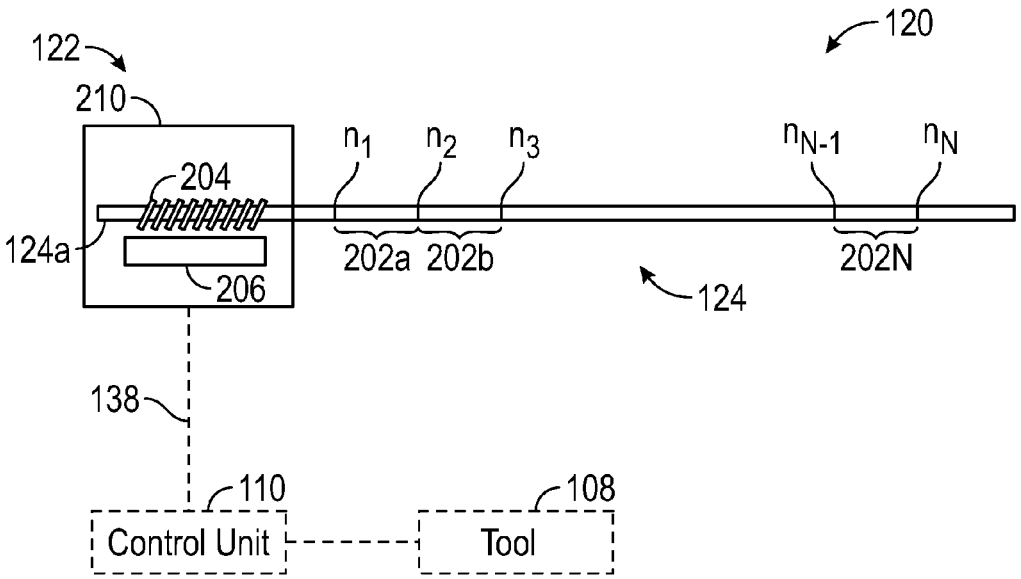
FIG. 2 shows an exemplary temperature sensor of the downhole system suitable for use in controlling downhole operations in an exemplary embodiment of the present disclosure.

FIG. 2 shows an exemplary temperature sensor 120 suitable for use in controlling downhole operations in an exemplary embodiment of the present disclosure. The temperature sensor 120 includes a metal probe 124 and a magnetostrictive transducer (MST) 122 coupled to the metal probe 124. The metal probe 124 may extend along a section of the work string (102, FIG. 1) and/or tool (108, FIG. 1). The temperature sensor 120 may be suitable for determining a temperature at a plurality of locations along the metal probe 124 via an ultrasonic pulse sent longitudinally along the metal probe 124. In an exemplary embodiment, a diameter of the metal probe 124 may be less than about 1 millimeter (mm) and the length of the metal probe 124 may be about 30 feet (about 10 meters). The metal probe may be made of a material, such as nickel/iron or Inconel, which is rust-resistant and suitable for use a temperatures of downhole environments, such as greater than about 350° Celsius.

Notches ($n_1, n_2, \ldots, n_N$) are formed at axially spaced-apart locations in the metal probe 124. The notches often may be separated by a few inches. In general, the notches ($n_1, n_2, \ldots n_N$) are circumferential notches that are equally spaced along the longitudinal axis of the metal probe 124 when the temperature of the metal probe 124 is constant along the metal probe 124. The notches ($n_1, n_2, \ldots n_N$) divide the metal probe 124 into segments or intervals (202*a*, 202*b*, . . . , 202N), wherein the intervals may have equal length when the temperature of the metal probe 124 is constant along the metal probe 124.

The MST 122 includes a coil 204 and a magnet 206, which may be a permanent magnet, contained within a housing 210. The magnet 206 may be used along with signals in the coil 204 to excite and detect ultrasonic pulses in the metal probe 124. The magnet 206 and coil 204 served to transform current into an ultrasonic pulse and vice-versa. An end portion 124*a* of the metal probe 124 extends into the housing and the coil 204 is wrapped around the end portion 124*a*. The coil 204 is coupled to the control unit 110 via a connector or cable 138, which may be a coaxial connector, for example. The control unit 110 may provide power and/or electrical signals to the coil 204. The connector 208 may be of a size suitable for a selected tool or operation. An electrical signal sent from the control unit 110 generates a changing magnetic field, causing magnetostriction at the end portion 124*a* of the metal probe 124 within the housing 210. The magnetostriction generates an outgoing ultrasonic pulse that propagates from the end portion 124*a* along the length of the metal probe 124 in a direction away from the coil 204. As the outgoing ultrasonic pulse propagates along the metal probe 124, each notch ($n_1, n_2, \ldots n_N$) reflects a portion or percentage of the outgoing ultrasonic pulse back towards the MST 122. The remaining portion or percentage of the outgoing ultrasonic pulse continues its propagation along the metal probe 124 away from the coil 204. A reflected ultrasonic pulse that is received at the MST 124 produces an electrical signal in the coil 204 which is sent to the control unit 110. Because the metal probe 124 includes a plurality of notches, the control unit 110 records a plurality of reflected signals, each corresponding to a selected notch in the metal probe 124.

As the temperature of the metal probe 124 increase or decreases, the modulus of elasticity of the probe changes and therefore the velocity of sound for the signal propagating through the metal probe 124 increases or decreases with temperature. Thus, determining the travel time between generating a pulse at a first location (e.g., at coil 204) and receiving its reflection from a second location (e.g., a selected notch such as notch $n_1$) may be used to determine a temperature at the second location (e.g., notch $n_1$). The increased velocity at elevated temperatures reduces the travel time for the ultrasonic pulse between the first location and the second location. Therefore, the temperature may be determined at a selected notch by determining a travel time between generating the out-going ultrasonic pulse and receiving a reflection from the notch of the generated pulse (i.e., the travel time for the ultrasonic pulse between the first location and the second location), and comparing the determined time to a time interval for an ultrasonic pulse between the first location and the second location at a known reference temperature. Although length of the metal probe 124 may also increase or decrease with temperature, such changes in length are substantially negligible. In another embodiment, since the length of the metal probe 124 changes linearly with temperature within the range of operation temperature of the tool, this length change may be pre-determined and its effect on the travel time of the ultrasonic pulse may be considered in temperature calculations.

The control unit 110 may therefore obtain temperature measurements at a plurality of locations (i.e., notches $n_1$, $n_2, \ldots, n_N$) by generating an ultrasonic pulse along the metal probe 124. The plurality of temperature measurements may be used to determine a temperature profile or a temperature map along a section of the wellbore 132 or work string 102. The temperature measurements may be related to a downhole operation such as operation of the downhole tool 108. The control unit 110 may therefore process the temperature measurements and control an operation of tool 108 using the processed temperature measurements. Alternatively, the control unit 110 may store the temperature measurements at the memory storage device 114 for calculations at a later time.

In various embodiments, the control unit 110 may monitor the temperature generated by the tool 108 at the selected downhole location using the temperature sensor 120 described herein. In various embodiments, a temperature threshold may be set for controlling the use of the tool. The control unit 110 or processor may then compare at least one of the temperature measurements against a selected threshold and alter an operation parameter of the tool 108 or a downhole operation when the comparison meets a selected criterion. For example, the processor may determine that the temperature profile is greater than the selected threshold or that the temperature profile is less than the selected threshold and control the tool corresponding to results of the comparison. Alternatively, the processor may determine that a subset of the temperature measurements (such as a selected temperature measurement) from the temperature profile is greater than the selected threshold or is less than the selected threshold and control the tool corresponding to results of the comparison. In one embodiment, when a downhole operation generates temperatures above the selected threshold, an operation parameter of the tool may be altered from a first value to a second value in order to maintain the temperature below the selected threshold. In some cases, the tool 108 may be turned off or the downhole operation interrupted when the temperature rises above the selected threshold.

Figure 3:
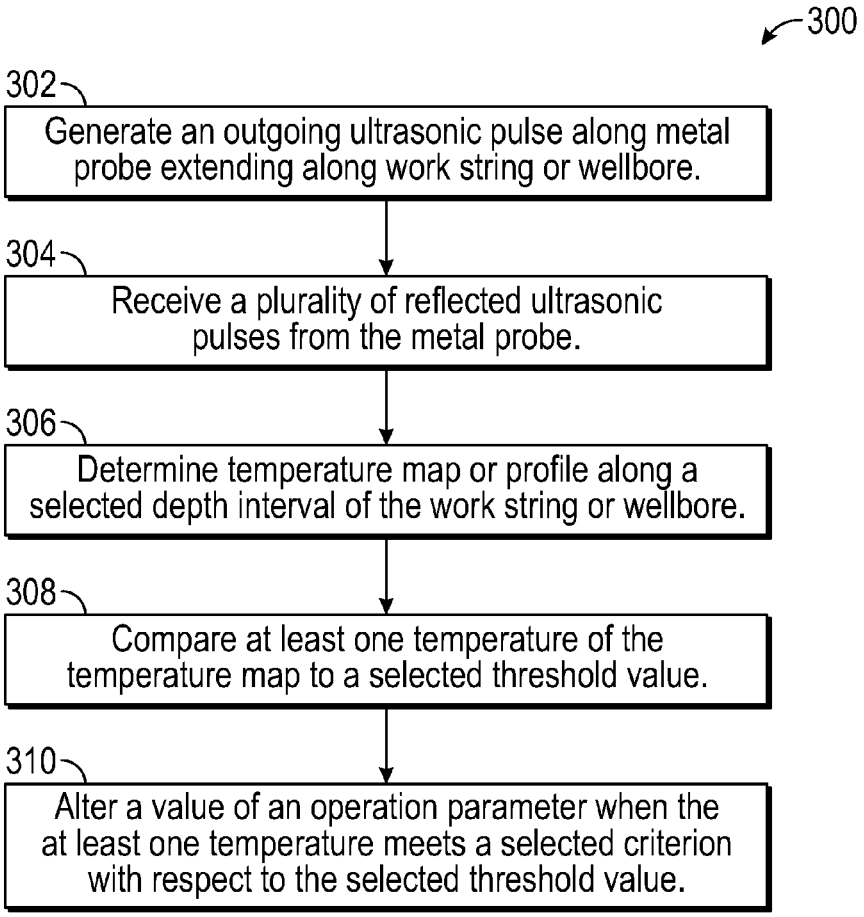
FIG. 3 shows a flowchart illustrating a method of controlling operations downhole using temperature measurement obtained using the exemplary temperature sensor of FIG. 2.

FIG. 3 shows a flowchart illustrating a method of controlling operations downhole using temperature measurement obtained using the temperature sensor disclosed herein. In block 302, an outgoing ultrasonic pulse is generated along the metal probe. The metal probe extends along the work string 102 or a depth interval in the wellbore 132. In block 304, a plurality of reflected ultrasonic pulses is received at the control unit 110. In block 306, the received plurality of reflected ultrasonic pulses is used to determine a temperature map of the interval of the work string 102 or wellbore 132. In block 308, the temperature map may be compared to a selected threshold value. At least one temperature may be compared to the selected threshold value. However, the entire temperature map may also be compared to the selected threshold value. In block 310, a value of an operational parameter of the tool of a downhole operation is altered when the at least one temperature of the temperature map meets a selected criterion with respect to the selected threshold value. A temperature measurement meeting the selected criterion may include the temperature measurement being greater than the selected threshold value or being less than the selected threshold value, in various embodiments.

Figure 4:
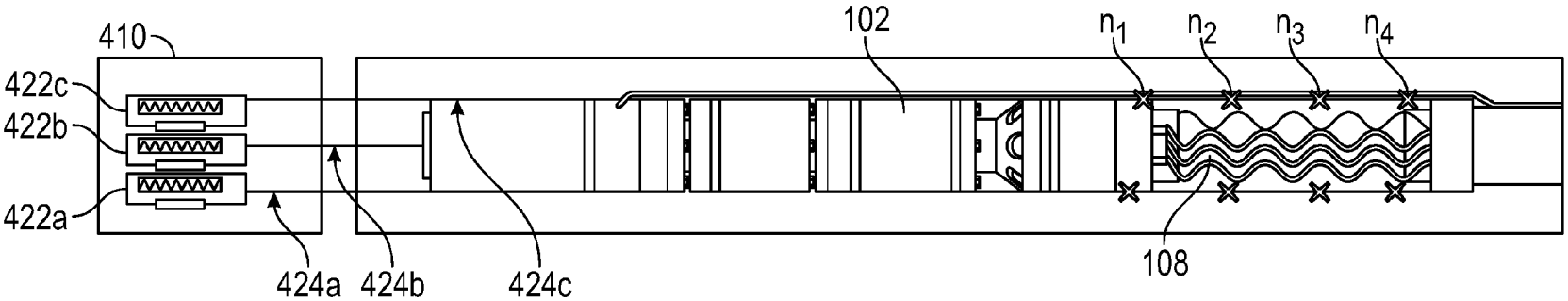
FIG. 4 shows an exemplary work string including multiple temperature sensors.

FIG. 4 shows an exemplary work string 102 including multiple temperature sensors, in one embodiment. As shown in FIG. 4, three metal probes 424*a*, 424*b*, and 424*c* extend longitudinally along an external surface of the work string. Each metal probe 424*a*, 424*b* and 424*c* has a respective MTS 422*a*, 422*b* and 422*c* associated with it stored in housing 410. MTS 422*a*, 422*b* and 422*c* send outgoing ultrasonic pulses and receive ultrasonic pulses reflected from notches $n_1$, $n_2$, $n_3$ and $n_4$, which are located along the downhole tool 108. Temperature measurements may thus be obtained at multiple circumferential locations around the downhole tool 108. Three metal probes and four notches in the metal probes are shown only for illustrative purposes, and any number of metal probes as well as any number of notches in the metal probes may be used in various embodiments.

Figure 5:
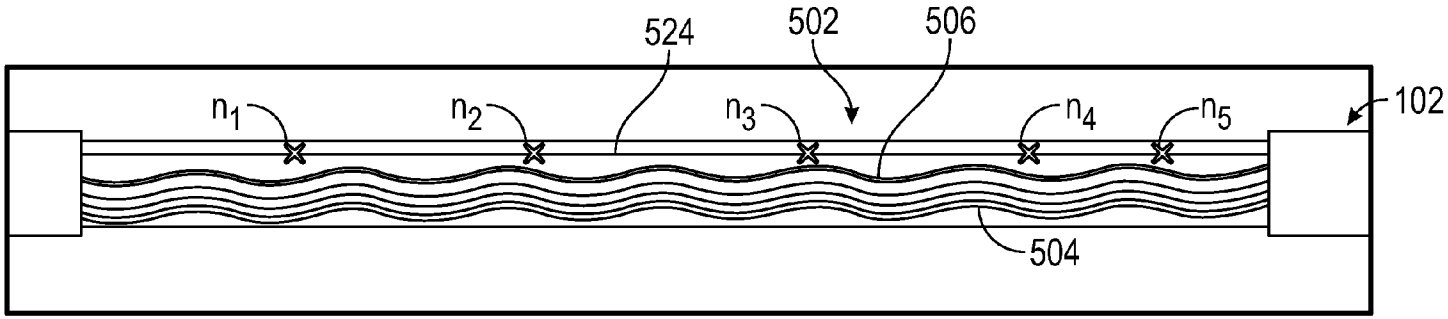
FIG. 5 shows an exemplary embodiment of a work string in which the temperature sensor is internally disposed within the work sting.

FIG. 5 shows an exemplary embodiment of a work string 102 in which the temperature sensor is internally disposed within the work sting 102. Metal probe 524 of the temperature sensor is disposed within an elastomeric material 506 of a stator 504 of a motor section 502 of the work string 102. Notches $n_1$, $n_2$, $n_3$, $n_4$ and $n_5$ are located along the length of the motor section 502. Five notches are shown for illustrative purposes only. Any number of notches may be used in various alternate embodiments. Temperature measurements may be obtained at various locations along the motor section 502 via reflection of ultrasonic pulses at notches $n_1$, $n_2$, $n_3$, $n_4$ and $n_5$. Such temperatures may be a result of a heat of friction resulting from operation of the motor section 502. Measuring the temperature along the motor section 502 may allow a user to change operation of the motor section 502 when one or more of the temperatures becomes too high.

Figure 6:
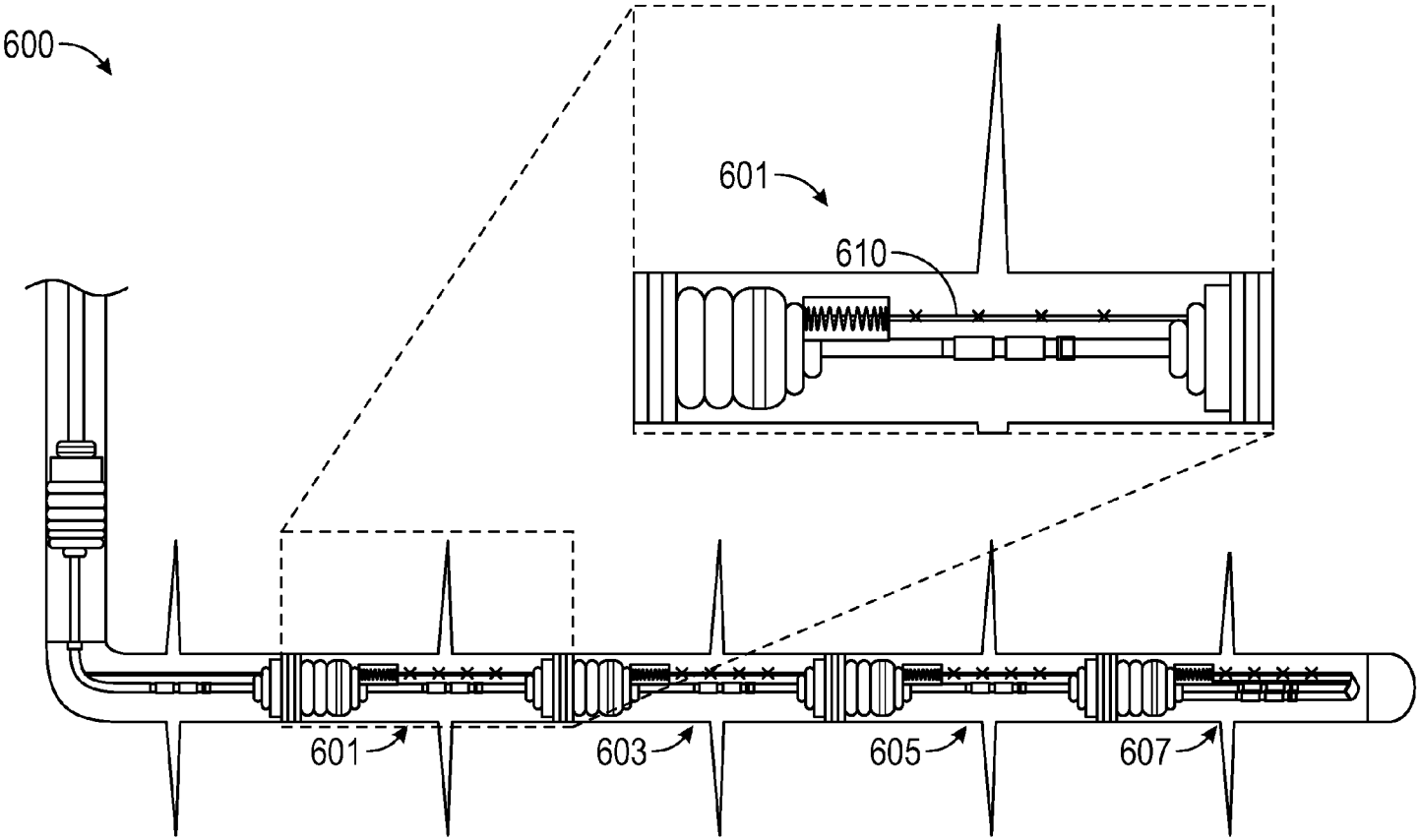
FIG. 6 shows another embodiment in which the temperature sensor is employed in a multi-stage fracturing system.

FIG. 6 shows another embodiment in which the temperature sensor may be used for a fracking operation. A multistage fracturing system 600 is shown along a section of a horizontal borehole. The fracturing system includes exemplary stages 601, 603, 605 and 607. At least one stage (e.g., stage 601) may include the exemplary temperature sensor 610 of the present disclosure extending along a length of stage 601. The temperature sensor 610 may be used to obtain a temperature profile along the length of the stage 601 resulting from fracking operations. The temperature profile may thus be used to change a fracking operation at stage 601 by, for example, increasing a rate of introducing acid into the formation, decreasing the rate of introducing acid into the formation, pausing or halting a stimulation operation, changing a stimulation schedule, etc.

Therefore in one aspect, the present disclosure provides a method of controlling a downhole operation, the method including: controlling a tool to perform the downhole operation at a selected downhole location using a first value of an operation parameter of the tool; using a magnetostrictive probe to determine a temperature profile along a section of a downhole tool or wellbore related to the operation being performed using the first value of the operation parameter; and compare the temperature profile to a selected threshold; and alter the operation parameter to a second value based on the comparison of the temperature profile to the selected threshold. The magnetostrictive probe includes at least a first notch and a second notch axially separated from each other by a selected interval. Using the magnetostrictive probe may further include generating an ultrasonic pulse at a first location of the magnetostrictive probe, receiving a reflection of the generated ultrasonic pulse from a notch at a second location of the magnetostrictive probe determining a travel time of the ultrasonic pulse between the first location and the second location, determining the temperature at the second location from the determined travel time and a reference travel time for an ultrasonic pulse between the first location and the second location at a known reference temperature. The operation may include, for example, a hydraulic fracturing operation; operation of an artificial lift system; operation of a drill string; operation of a drill bit; operation of a flow control device; operation of a hydraulic motor; operation of a perforating system; and a wellbore or formation temperature monitoring operation. A selected temperature measurement from the temperature profile may be compared to the selected threshold value and the operation parameter may be altered to the second value based on the comparison of the selected temperature to the selected threshold. Comparing the temperature profile to the selected threshold may also include one of: (i) determining the temperature profile to be greater than the selected threshold; (ii) determining the temperature profile to be less than the selected threshold; (iii) determining a selected temperature measurement from the temperature profile to be greater than the selected threshold; and (iv) determining a selected temperature measurement from the temperature profile to be less than the selected threshold. In various embodiments, the magnetostrictive probe is made of a material resistant to rust in a downhole environment.

In another aspect, the present disclosure provides an apparatus for controlling an operation downhole, the apparatus including: a tool configured to perform the operation at a downhole location according to an operation parameter of the tool; a magnetostrictive probe extending along a section of tool configured to obtain a temperature profile along the section of the tool related to the operation being performed by the tool; a processor configured to: determine a temperature profile along a section of a wellbore related to the operation using the magnetostrictive probe, compare the temperature profile to a selected threshold, and alter the operation parameter based on the comparison of the temperature profile to the selected threshold. The magnetostrictive probe generally includes at least a first notch and a second notch axially separated from each other by a selected interval. The processor activates a transducer to generate an ultrasonic pulse at a first location of the magnetostrictive probe, receives a signal from the transducer related to a reflection of the generated ultrasonic pulse from a notch at a second location of the magnetostrictive probe, determines a travel time of the ultrasonic pulse between the first location and the second location, and determines the temperature at the second location from the determined travel time and a reference travel time for an ultrasonic pulse between the first location and the second location at a known reference temperature. The tool may be at least one of: a hydraulic fracturing system; an artificial lift system; a drill string; a drill bit; a flow control device; a hydraulic motor; a perforating system; and a downhole tool. The processor may also compare a selected temperature measurement from the temperature profile to the selected threshold value and alter the operation parameter based on the comparison of the selected temperature to the selected threshold. Also, the processor may compare the temperature profile to the selected threshold by performing at least one of: (i) determining the temperature profile to be greater than the selected threshold; (ii) determining the temperature profile to be less than the selected threshold; (iii) determining a selected temperature measurement from the temperature profile to be greater than the selected threshold; and (iv) determining a selected temperature measurement from the temperature profile to be less than the selected threshold. The magnetostrictive probe may include a material encapsulated by either an anti-corrosion material or an anti-scaling material or both.

In yet another aspect, the present disclosure provides a system for controlling a downhole operation, the system including: a work string; a tool conveyed by the work string at a downhole location in a wellbore, a tool configured to perform the downhole operation using an operation parameter; a magnetostrictive probe extending along the workstring configured to obtain a temperature profile related to the downhole operation; and a processor configured to: receive the temperature profile from the magnetostrictive probe, compare the temperature profile to a selected threshold, and alter the operation parameter based on the comparison of the temperature profile to the selected threshold. The magnetostrictive probe may include at least a first notch and a second notch axially separated from each other by a selected interval. The processor activates a transducer to generate an ultrasonic pulse at a first location of the magnetostrictive probe, receives a signal from the transducer related to a reflection of the generated ultrasonic pulse from a notch at a second location of the magnetostrictive probe, determine a travel time of the ultrasonic pulse between the first location and the second location, and determines the temperature at the second location from the determined travel time and a reference travel time for an ultrasonic pulse between the first location and the second location at a known reference temperature. In various embodiments, the tool may be at least one of: a hydraulic fracturing system; an artificial lift system; a drill string; a drill bit; a flow control device; a hydraulic motor; a perforating system; and a downhole tool. The processor is may compare an individual temperature measurement from the temperature profile to the selected threshold value and alter the operation parameter based on the comparison of the temperature profile to the selected threshold. Also, the processor may compare the temperature profile to the selected threshold by performing at least one of: (i) determining the temperature profile to be greater than the selected threshold; (ii) determining the temperature profile to be less than the selected threshold; (iii) determining a selected temperature measurement from the temperature profile to be greater than the selected threshold; and (iv) determining a selected temperature measurement from the temperature profile to be less than the selected threshold.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

What is claimed is:

1. A method of controlling a downhole operation, comprising:

controlling a tool to perform the downhole operation at a selected downhole location using a first value of an operation parameter of the tool, wherein a magnetostrictive probe extends along a section of the tool for determining a temperature profile along the section of the tool related to the operation being performed using the first value of the operation parameter; and using a processor to:

activate a transducer at a first location of the magnetostrictive probe to generate an ultrasonic pulse at the first location, receive a signal from the transducer related to a reflection of the generated ultrasonic pulse from a first notch at a second location of the magnetostrictive probe, determine a travel time of the ultrasonic pulse between the first location and the second location, determine a temperature at the second location from the determined travel time and a reference travel time for an ultrasonic pulse between the first location and the second location at a known reference temperature, determine, from the temperature at the second location, a temperature profile along the section of the tool;

compare the temperature profile to a selected threshold, and alter the operation parameter to a second value based on the comparison of the temperature profile to the selected threshold.

2. The method of claim 1, wherein the magnetostrictive probe includes at least the first notch and a second notch axially separated from each other by a selected interval.

3. The method of claim 1, wherein the operation includes at least one of: a hydraulic fracturing operation; operation of an artificial lift system; operation of a drill string; operation of a drill bit; operation of a flow control device; operation of a hydraulic motor; operation of a perforating system; and a wellbore or formation temperature monitoring operation.

4. The method of claim 1, further comprising comparing a selected temperature measurement from the temperature profile to the selected threshold value and altering the operation parameter to the second value based on the comparison of the selected temperature to the selected threshold.

5. The method of claim 1, wherein comparing the temperature profile to the selected threshold further comprises: (i) determining the temperature profile to be greater than the selected threshold; (ii) determining the temperature profile to be less than the selected threshold; (iii) determining a selected temperature measurement from the temperature profile to be greater than the selected threshold; and (iv) determining a selected temperature measurement from the temperature profile to be less than the selected threshold.

6. The method of claim 1, wherein the magnetostrictive probe further comprises a material resistant to rust in a downhole environment.

7. An apparatus for controlling an operation downhole, comprising:

a tool configured to perform the operation at a downhole location according to an operation parameter of the tool;

a magnetostrictive probe extending along a section of the tool configured to obtain a temperature profile along the section of the tool related to the operation being performed by the tool;

a transducer at a first location of the magnetostrictive probe;

a processor configured to:

activate the transducer to generate an ultrasonic pulse at the first location of the magnetostrictive probe, receive a signal from the transducer related to a reflection of the generated ultrasonic pulse from a first notch at a second location of the magnetostrictive probe, determine a travel time of the ultrasonic pulse between the first location and the second location, determine a temperature at the second location from the determined travel time and a reference travel time for an ultrasonic pulse between the first location and the second location at a known reference temperature, determine, from the temperature at the second location, a temperature profile along a section of the tool related to the operation, compare the temperature profile to a selected threshold, and alter the operation parameter based on the comparison of the temperature profile to the selected threshold.

8. The apparatus of claim 7, wherein the magnetostrictive probe includes at least the first notch and a second notch axially separated from each other by a selected interval.

9. The apparatus of claim 7, wherein the tool further includes at least one of: a hydraulic fracturing system; an artificial lift system; a drill string; a drill bit; a flow control device; a hydraulic motor; a perforating system; and a downhole tool.

10. The apparatus of claim 7, wherein the processor is further configured to compare a selected temperature measurement from the temperature profile to the selected threshold value and alter the operation parameter based on the comparison of the selected temperature to the selected threshold.

11. The apparatus of claim 7, wherein the processor is further configured to compare the temperature profile to the selected threshold by performing at least one of: (i) determining the temperature profile to be greater than the selected threshold; (ii) determining the temperature profile to be less than the selected threshold; (iii) determining a selected temperature measurement from the temperature profile to be greater than the selected threshold; and (iv) determining a selected temperature measurement from the temperature profile to be less than the selected threshold.

12. The apparatus of claim 7, wherein the magnetostrictive probe further comprises a material encapsulated by at least one of an anti-corrosion material and an anti-scaling material.

13. A system for controlling a downhole operation, comprising:

a work string;

a tool conveyed by the work string at a downhole location in a wellbore, a tool configured to perform the downhole operation using an operation parameter;

a magnetostrictive probe extending along a section of the workstring configured to obtain a temperature profile related to the downhole operation;

a transducer at a first location of the magnetostrictive probe; and a processor configured to:

activate the transducer to generate an ultrasonic pulse at the first location of the magnetostrictive probe, receive a signal from the transducer related to a reflection of the generated ultrasonic pulse from a first notch at a second location of the magnetostrictive probe, determine a travel time of the ultrasonic pulse between the first location and the second location, determine the temperature at the second location from the determined travel time and a reference travel time for an ultrasonic pulse between the first location and the second location at a known reference temperature, determine, from the temperature at the second location, a temperature profile along the section of the workstring related to the operation, compare the temperature profile to a selected threshold, and alter the operation parameter based on the comparison of the temperature profile to the selected threshold.

14. The system of claim 13, wherein the magnetostrictive probe includes at least the first notch and a second notch axially separated from each other by a selected interval.

15. The system of claim 13, wherein the tool further includes at least one of: a hydraulic fracturing system; an artificial lift system; a drill string; a drill bit; a flow control device; a hydraulic motor; a perforating system; and a downhole tool.

16. The system of claim 13, wherein the processor is further configured to compare an individual temperature measurement from the temperature profile to the selected threshold value and alter the operation parameter based on the comparison of the temperature profile to the selected threshold.

17. The system of claim 13, wherein the processor is further configured to compare the temperature profile to the selected threshold by performing at least one of: (i) determining the temperature profile to be greater than the selected threshold; (ii) determining the temperature profile to be less than the selected threshold; (iii) determining a selected temperature measurement from the temperature profile to be greater than the selected threshold; and (iv) determining a selected temperature measurement from the temperature profile to be less than the selected threshold.

* * * * *